US006486859B1

(12) United States Patent
Croll et al.

(10) Patent No.: US 6,486,859 B1
(45) Date of Patent: Nov. 26, 2002

(54) COLOR DISPLAYS

(75) Inventors: Michael George Croll, West Sussex (GB); John Oliver Drewery, Surrey (GB)

(73) Assignee: British Broadcasting Corporation, Surrey (GB)

( * ) Notice: Subject to any disclaimer, the term of this patent is extended or adjusted under 35 U.S.C. 154(b) by 0 days.

(21) Appl. No.: 09/357,637

(22) Filed: Jul. 20, 1999

(30) Foreign Application Priority Data

Jul. 21, 1998 (GB) ..... 9815907

(51) Int. Cl.[7] ..... G09G 3/28
(52) U.S. Cl. ..... 345/72; 345/690
(58) Field of Search ..... 345/60, 72, 150, 345/153, 152, 690

(56) References Cited

U.S. PATENT DOCUMENTS 4,583,120 A * 4/1986 Murakami et al. ..... 348/614
5,272,468 A 12/1993 Read
5,280,353 A * 1/1994 Baldwin ..... 348/674
5,381,182 A * 1/1995 Miller et al. ..... 348/448
5,436,634 A * 7/1995 Kanazawa et al. ..... 345/67
5,604,513 A 2/1997 Takahashi et al.
5,777,692 A * 7/1998 Ghosh ..... 348/725
5,841,413 A * 11/1998 Zhu et al. ..... 345/63
5,920,299 A * 7/1999 Ohshima ..... 345/88
6,018,329 A * 1/2000 Kida et al. ..... 345/60
6,078,307 A * 6/2000 Daly ..... 345/132
6,078,317 A * 6/2000 Sawada ..... 345/204
6,097,368 A * 8/2000 Zhu et al. ..... 345/153
6,259,425 B1 * 7/2001 Shimizu ..... 345/94

FOREIGN PATENT DOCUMENTS

EP 511 802 4/1992

OTHER PUBLICATIONS

Fujitsu Co. News Release "Fujitsu Announces World's First Commercial 42–inch–diagonal Wide–Screen Color Plasma Display", Aug. 24, 1995, 2 pages.

* cited by examiner

*Primary Examiner*—Steven Saras
*Assistant Examiner*—Uchendu O. Anyaso
(74) *Attorney, Agent, or Firm*—Flynn, Thiel, Boutell & Tanis, P.C.

(57) ABSTRACT

A plasma display device (10) is provided with circuitry (50) which modifies at least the R and B color component signals so as to compensate for the displacement of the display elements or sub-pixels for each color component relative to each other in the array. Surprisingly, this increases the ratio of wanted signal to alias spectrum. The modification is effected by an interpolator comprising transversal filters (31R, 31B). The circuitry can be combined with down-converters (52) when a high definition source is used. In this case a transversal filter (31G) is also included for the G color component signal.

21 Claims, 13 Drawing Sheets amplitude
corrected
uncorrected
$f_s$
frequency
$2f_s$
$3f_s$ 14
16
18
20
$f_s^{-1}$
$(3f_s)^{-1}$

COLOR DISPLAYS

BACKGROUND OF THE INVENTION

This invention relates to color display devices, for use in television displays, computer monitors, and the like.

Conventional displays, using cathode ray tube (CRT) display devices, operate with a series of horizontal lines written continuously on the display in a vertical progression. The lines may be written continuously from top to the bottom (progressive, continuous or non-interlaced scan) or, more traditionally in broadcast receivers the odd numbered lines may be written first on one field and the even numbered lines then written on the next field (interlaced scan). For present purposes there is no material difference between progressive and interlaced scan; they both scan line-by-line and are supplied with an essentially continuous video signal which represents what may be regarded as picture elements or pixels along successive lines. Although referred to as pixels or picture elements, in the received analog video signal the pixels are not discrete, but rather the signal is completely continuous during each line. The lines are sufficient in number to be invisible to the normal user at the normal viewing distance.

To provide color on the display a cathode ray tube has three guns which receive analog red, green and blue (RGB) color-component signals respectively, and which are arranged to place red, green and blue spots closely together on the display screen. The three elemental color areas are not superposed, but are placed side-by-side. In a traditional shadow mask tube, illustrated in FIGS. 1A, 1B and 1C of the drawings, they are in a triangular arrangement of dots. In another type of tube known as the striped tube, illustrated in FIGS. 2A, 2B and 2C, the color regions are in narrow vertical stripes down the screen. In either event, the three color components of such a triplet are derived from the same instant of the video signal, but are positioned on the display at very slightly different locations. The video signal can be said to be sampled in this process. The three points of color can be referred to as sub-pixels. The sub-pixels are sufficiently close to render the sampling invisible.

A new type of display, which may be termed a discrete color display or matrix display, is now being developed, which consists of a two-dimensional array of separate display elements. An example of such a display is a plasma display. In this case also, the sub-pixels are not coincident on the display but appear at difference places on the overall display. They may be arranged in stripes as in the striped display. In this case the separate display elements are separately addressed, each with a separate pixel value, with successive samples, which have been taken from an appropriate continuous video signal.

We have appreciated that the spatial separation of the dots or stripes on the screen means that the information is not being displayed at precisely the correct point. Putting it another way, the information that should be displayed at the red sub-pixel should differ as regards the precise instant in the red video signal from which it is taken such as to reflect the spatial difference in the location of the red sub-pixel from the green and blue sub-pixels.

We have appreciated that with existing analog CRT displays this effect is obtained by adjusting the relative timing between the instants that the red, green and blue beams excite the phosphors as they sweep across the sub-pixels. This adjustment takes place during the convergence operation, which is part of the CRT setting-up procedure and can be explained as follows. A visual convergence adjustment takes place in which the scans are laterally adjusted so as to produce the optimum image as judged by a visual observer. FIG. 3 shows the relative disposition of the sub-pixels, guns and shadow-mask apertures with superposed beam positions corresponding to three adjacent sets of sub-pixels. It will be appreciated that,for the purposes of illustration the distance from the guns to the shadow-mask has been considerably reduced compared to the distance from the shadow-mask to the pixels. FIGS. 4A, 4B and 4C show the beam positions at three successive instants of time as the beams sweep from left to right. It can be seen that the spacing;of the beams is such that two of the beams are blocked when the third is exciting the appropriate phosphor. This has the effect of three-fold interleaving the times in the red, green and blue signals when the appropriate phosphors are excited.

U.S. Pat. No. 5,604,513 describes video display apparatus using a matrix display. Analog color component signals are received and serially sampled for application sequentially to the matrix display. The inventor specifically wishes the three horizontally-spaced color components to represent the same point in time, and therefore includes a one-third pixel delay in one component signal path and a two-thirds pixel delay in another of the component paths. This in fact introduces a problem similar to that noted above.

SUMMARY OF THE INVENTION

The present invention is defined in the independent claims below, to which reference should now be made. Advantageous features are set forth in the appendant claims.

In accordance with this invention we have appreciated that a discrete digitally-driven display can, however, be improved by modifying the signal samples to take account of the sub-pixel shift.

Where the sample rate of the RGB signals is the same as that of the display, this modification preferably takes the form of an interpolation of the R and B samples to new samples which are offset by the R and B sub-pixel shift from the G samples. Where the sample rate (samples/line) of the RGB signals is different from that of the display, all three sets of samples need to be interpolated, again allowing for the shift offset.

The improvement is, in principle, applicable to both one-dimensional and two-dimensional sampling situations. One-dimensional sampling arises with a display where the colors are arranged in stripes where the sub-pixels of a color are vertically aligned, whereas two-dimensional sampling arises in particular where the sub-pixels are arranged in a group of dots. For ease of explanation the following description by way of example will be made in relation to a one-dimensional arrangement. Those skilled in the art will be able to expand the treatment to the two-dimensional situation.

BRIEF DESCRIPTION OF THE DRAWINGS

The invention will now be described in more detail, by way of example, with reference to the accompanying drawings, in which.

DETAILED DESCRIPTION OF THE PREFERRED EMBODIMENT

Figure 1A:
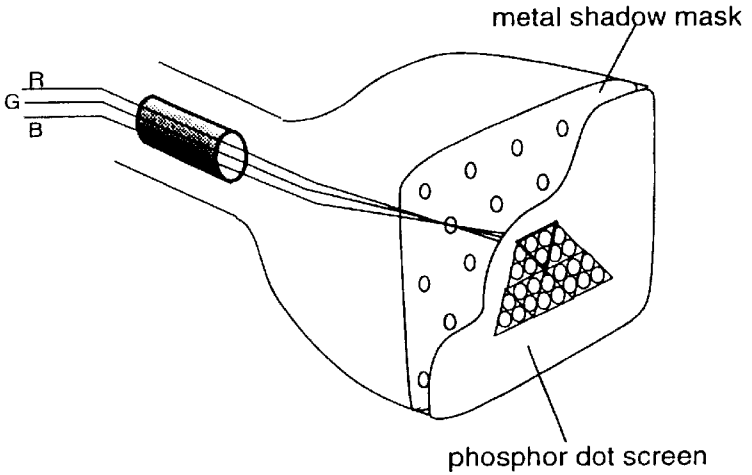
FIG. 1A (PRIOR ART)
FIGS. 1A, 1B and 1C, respectively, illustrate a traditional shadow mask cathode ray tube display device, a shadow mask and the tube dot array.
Figure 1B:
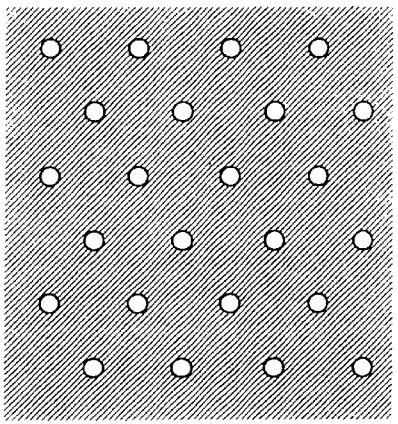
FIG. 1B (PRIOR ART)
Figure 1C:
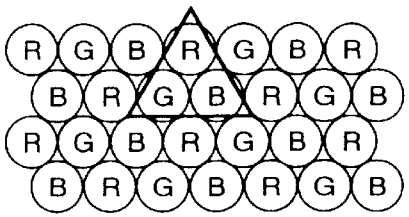
FIG. 1C (PRIOR ART)
Figure 2A:
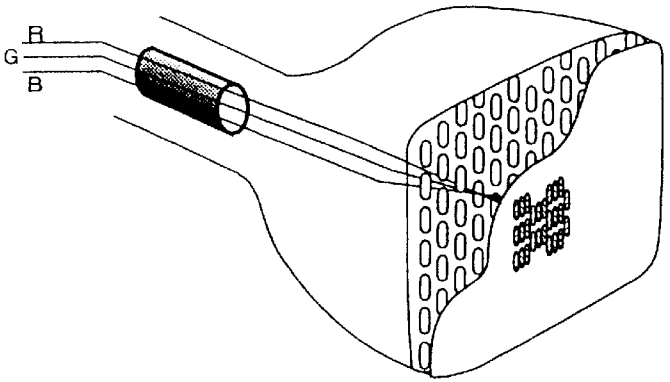
FIG. 2A (PRIOR ART)
FIGS. 2A, 2B and 2C, respectively, illustrate a known striped tube CRT display device, the display mask and the color strips.
Figure 2B:
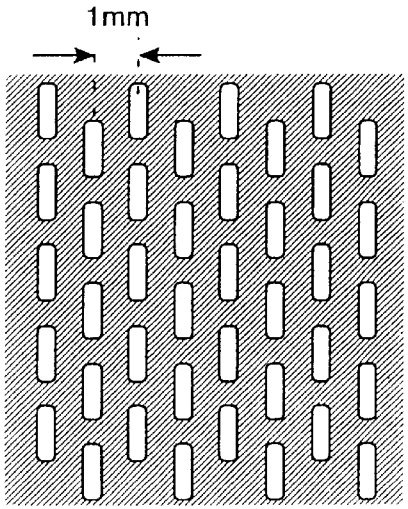
FIG. 2B (PRIOR ART)
Figure 2C:
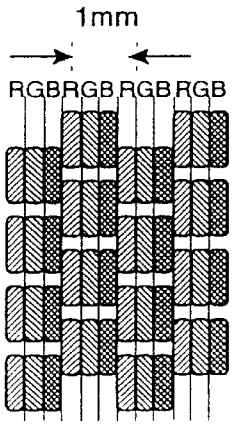
FIG. 2C (PRIOR ART)
Figure 3:
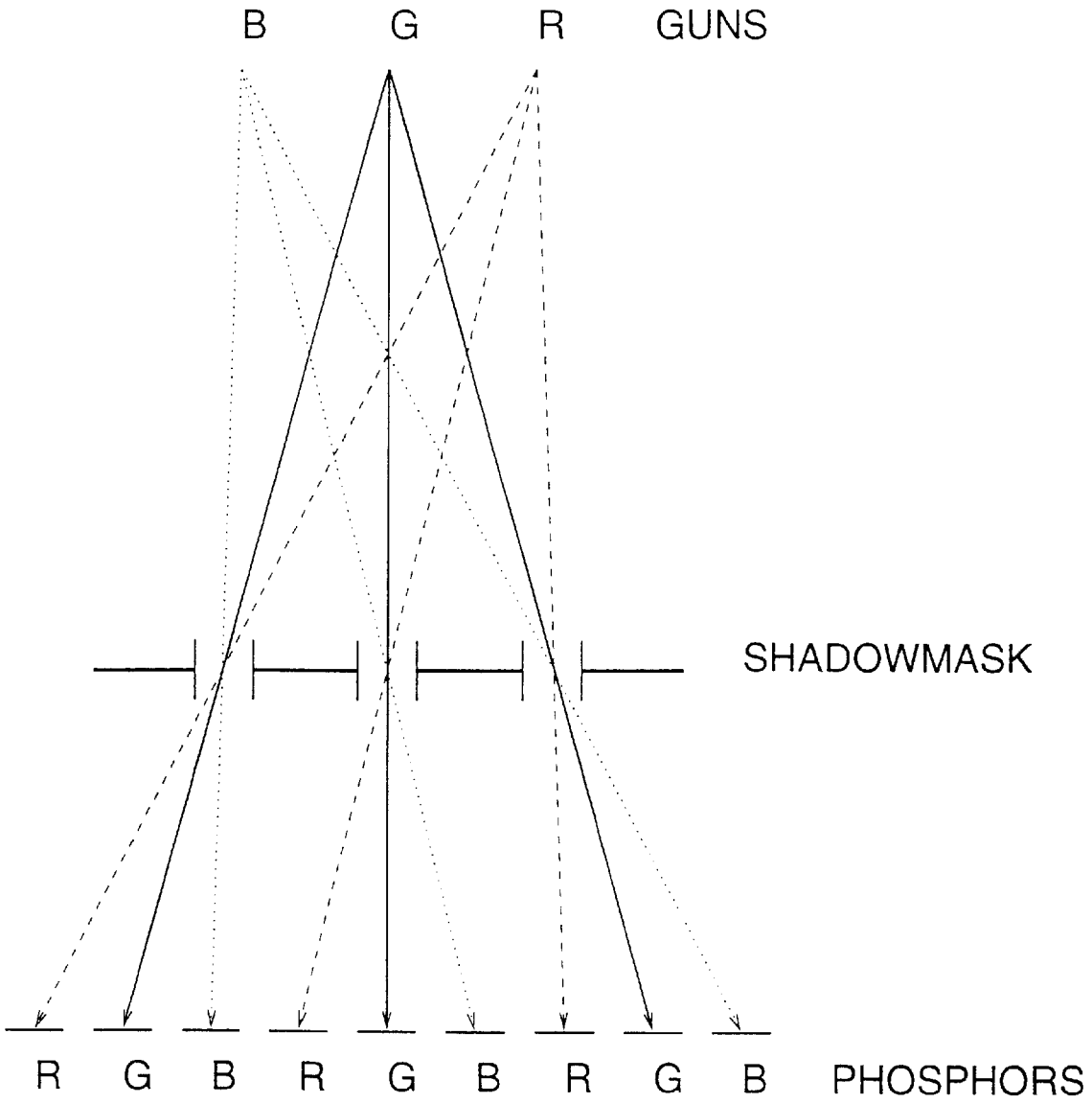
FIG. 3 (PRIOR ART)
FIG. 3 shows the relative disposition of the guns, shadow-mask, and apertures in a conventional CRT display.
Figures 4A, 4B, 4C:
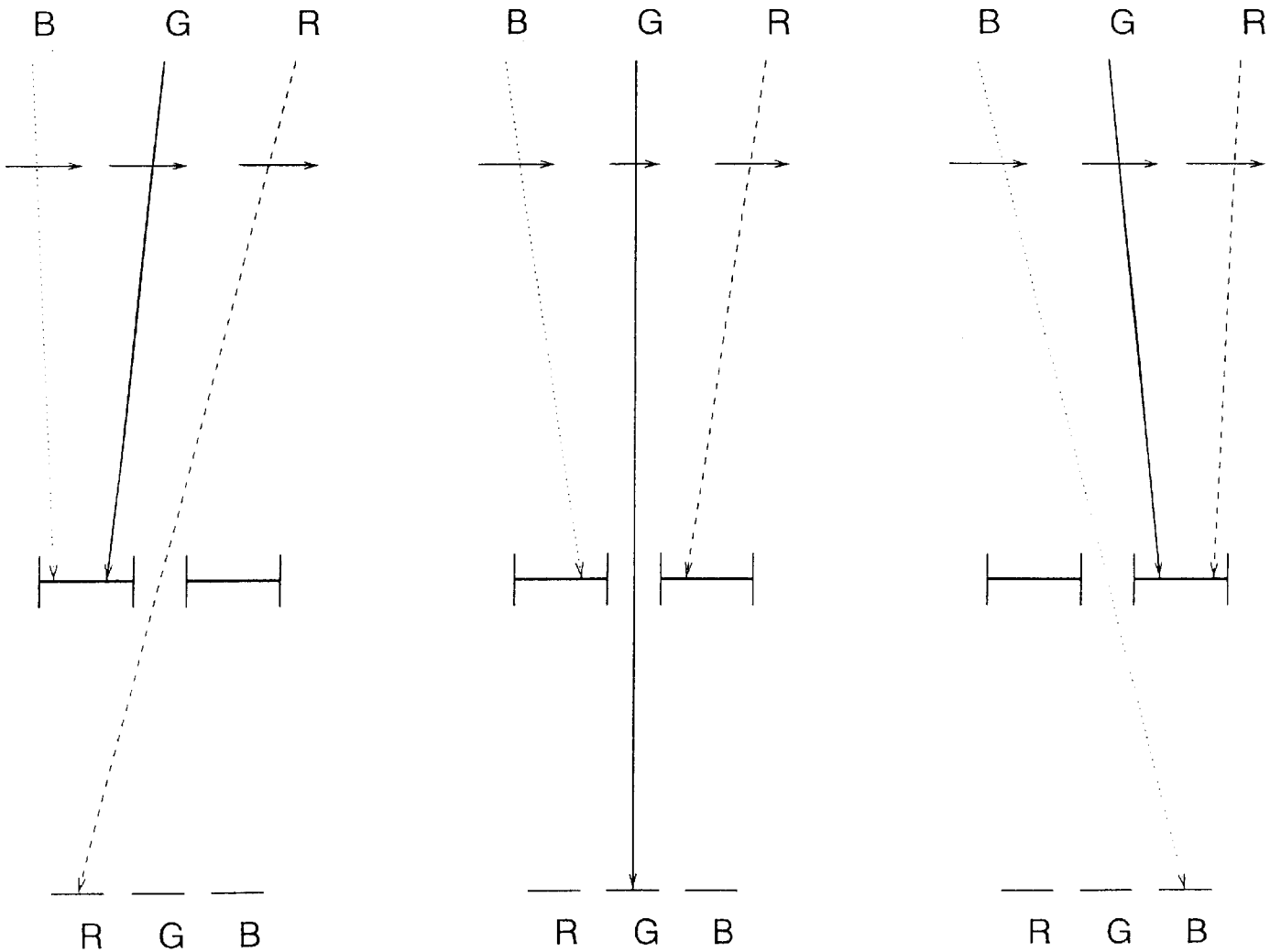
FIG. 4A (PRIOR ART)
FIG. 4B (PRIOR ART)
FIG. 4C (PRIOR ART)
FIGS. 4A, 4B and 4C, illustrate the beam positions in a CRT display at three successive instants of time.
Figure 5:
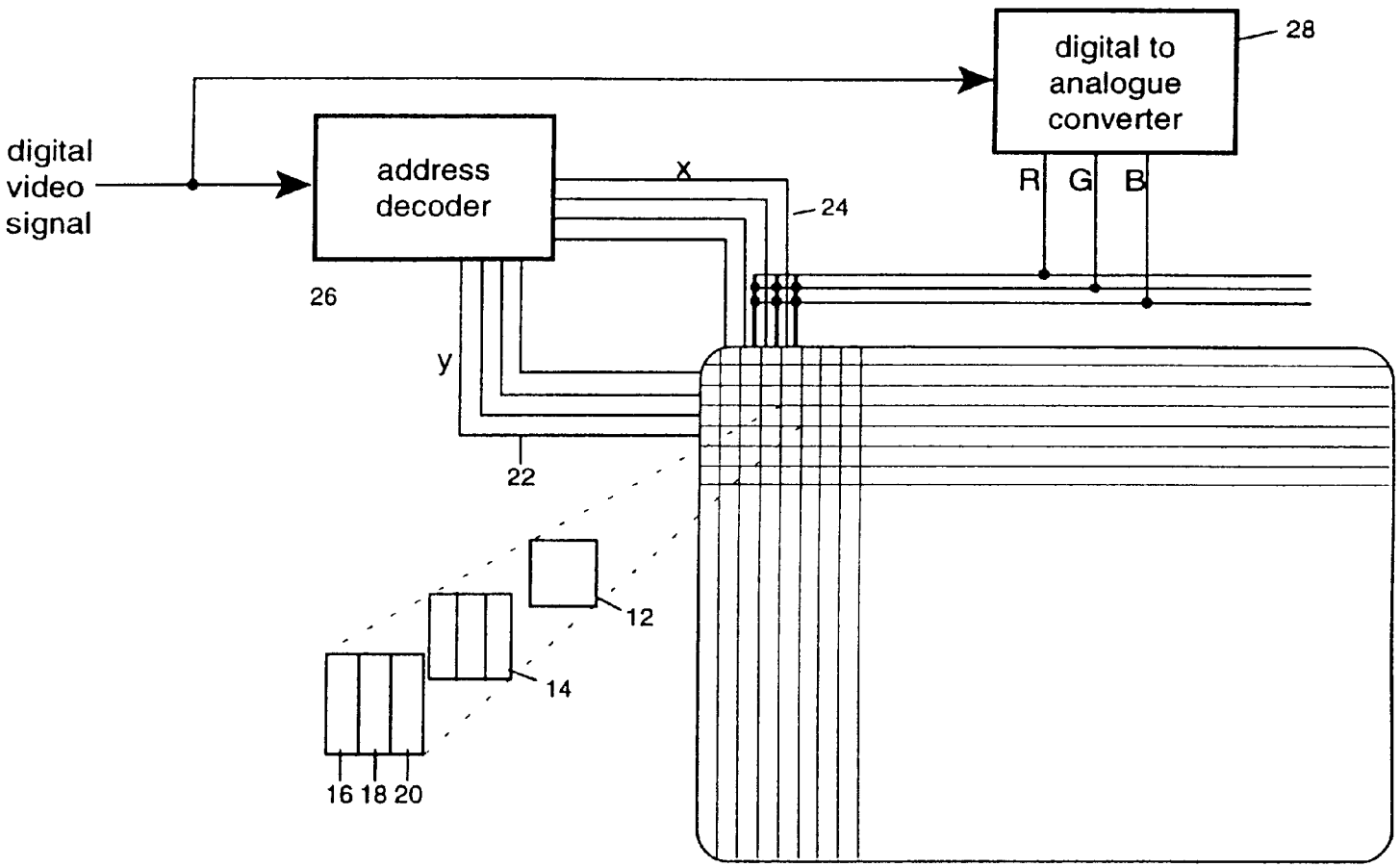
FIG. 5 illustrates a plasma display with its supply circuitry; indicated.

An example will now be described in detail with reference to the drawings which is based on the use of a plasma display device such as the Fujitsu P-42RM01-B plasma display. This has a discrete display structure both horizontally and vertically, and has a 16:9 aspect ratio with 480 rows of 852 pixels, the individual pixels being square. As it is a color display, each pixel corresponds to a triplet of R, G and B sub-pixels which are arranged in vertical columns like a striped cathode ray tube. FIG. 5 is a schematic view of the plasma display 10. The two-dimensional display comprises the 480 by 852 array of separate pixels 12, each pixel comprising three sub-pixels 14. Of these there are sub-pixels 16 for red, sub-pixels 18 for green, and sub-pixels 20 for blue repeated across the image area. It will be appreciated that FIG. 5 is diagrammatic and is not to scale. The display has row lines 22 and column lines 24 which are activated to address an individual sub-pixel. Enabling an individual row line and an individual column line will activate or enable the sub-pixel which is located at their point of intersection. That is, if a signal is applied to the ith row line 22 and a signal is applied to the jth column line 24, one of the ij sub-pixels 14 will be enabled. This may be one of the red or the green or the blue sub-pixels depending on the selected column line. The column lines correspond to the red, green and blue sub-pixels successively.

The row and column lines are fed through addressing circuitry 26 which receives the input digital signal and addresses the row and column lines in synchronism with the incoming digital signal. In addition, there is digital-to-analog circuitry 28 which receives the input digital signal and produces analog signals that excite each sub-pixel. In this way the successive sub-pixels in the display are supplied with information which is appropriate to their location.

The plasma display can be driven from standard REC 601 (ITU Recommendation 601) digital broadcast signals, having 576 active lines of 702 active pixels, with the interlace up-converted to progressive or non-interlaced scan. The pixels in REC 601 signals are not exactly square, as they are in the plasma display 10, and consequently, if a one-to-one mapping is maintained between the source raster, namely that of the incoming signal, and the display pixels, the geometry is compromised.

In principle, the input color component signals could be sampled analog signals as an alternative to digital signals, in which case a converter 28 may not be necessary.

In order to adjust the information applied to the individual sub-pixels to take account of the lateral displacement of the red and blue pixels from the green or central pixels, additional circuitry is included in the feed of the input signals to the digital-to-analog circuits 28. Assuming that the source is sampled at the same rate in terms of samples per line as the display, that is that there is a one-to-one relationship between received samples and displayed sub-pixels, the additional circuitry comprises a fixed interpolator circuit 30 illustrated in detail in FIG. 6. The interpolator circuit 30 takes the form of a pair of fixed transversal filters 31R, 31B which operate on the red and blue component signals respectively, while passing the green component signal unchanged. That is, the interpolator circuit 30 has three inputs 32R, 32G and 32B for receiving the co-timed red, green and blue digital color-component signals respectively. The green signal input 32G is connected through a delay element 36 to a green output terminal 34G. The red signal input 32R is connected to a series of one-sample delay elements 38R. The output of each delay element 38R is supplied to the succeeding delay element and is also supplied to a respective one of a series of multipliers 40R. Each multiplier receives a corresponding multiplier coefficient $c_i$, held in a long-term store (not shown). The outputs of the multipliers 40R are added in an adder 42R, the output of which forms the red signal output 34R of the interpolator circuit. Similar circuitry to that for the red signal is included for the blue signal. As is well known with transversal filters, the multiplier coefficients are chosen so as to give the required filter response. The output is created by a linear combination of the input samples for each color component. The number of samples and hence of stages in each transversal filter will be chosen so as to give the required degree of flatness of the frequency characteristic over the nominal video band.

Assuming as noted above that the source is sampled at the same rate in terms of samples per line as the display, that is that there is a one-to-one relationship between received samples and displayed sub-pixels, Table 1 below shows a possible set of coefficients. These coefficients can be used for a characteristic which is flat to 40.74% of the sampling frequency, that is 5.5 MHZ for a signal sampled at 13.5

MHZ. As is seen from FIG. 6, the coefficient pattern for the transversal filter operating on the blue signal is the mirror image of that for the transversal filter operating on the red signal. The delay element 36 in the path of the green signal is simply an equalising delay and is half the total length of the delays 38 in either one of the red and blue paths.

TABLE 1

| | |
|---|---|
| −8 | −0.000154 |
| −7 | 0.002769 |
| −6 | −0.009513 |
| −5 | 0.021885 |
| −4 | −0.042485 |
| −3 | 0.077508 |
| −2 | −0.148265 |
| −1 | 0.406332 |
| 0 | 0.823213 |
| 1 | −0.192842 |
| 2 | 0.095003 |
| 3 | −0.052036 |
| 4 | 0.027648 |
| 5 | −0.012918 |
| 6 | 0.004496 |
| 7 | −0.000640 |

In the example described above the green signal is unprocessed and the blue and red signals processed. It would of course alternatively be possible to leave the blue unprocessed and advance the green and delay the red, or, equally, to leave the red unprocessed and advance the blue and delay the green.

Theoretical Basis

Figure 7:
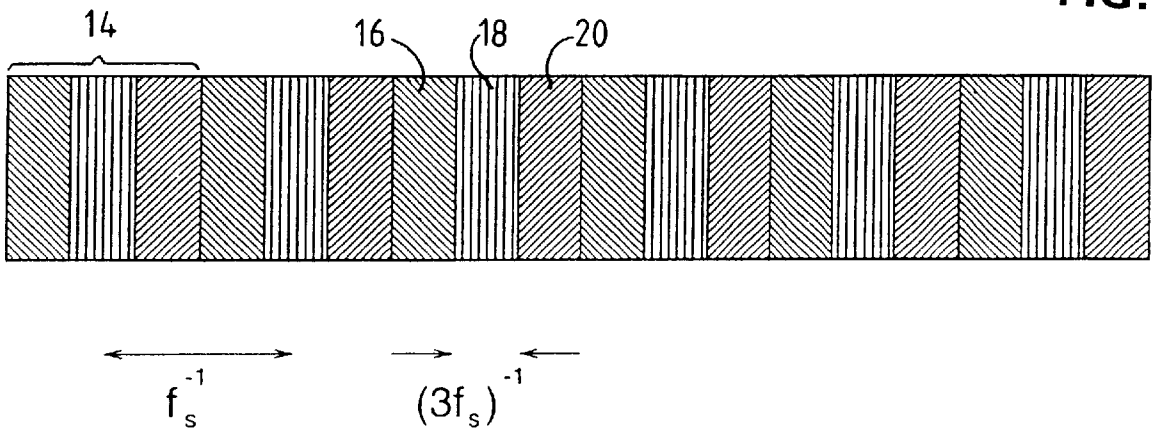
FIG. 7 is a diagram schematically illustrating an idealized arrangement of RGB triplets in a plasma display device.

The theoretical basis for the system described above will now be explained. FIG. 7 illustrates the arrangement of the RGB triplets 14 in the plasma display, assuming that there is no guard space between the R, G and B sub-pixels 16, 18 and 20 or between the triplets 14 themselves. First of all the situation without the addition of the interpolator circuit 30 will be considered, by reference to the green signal, where the interpolator has no relevant effect.

Figure 8:
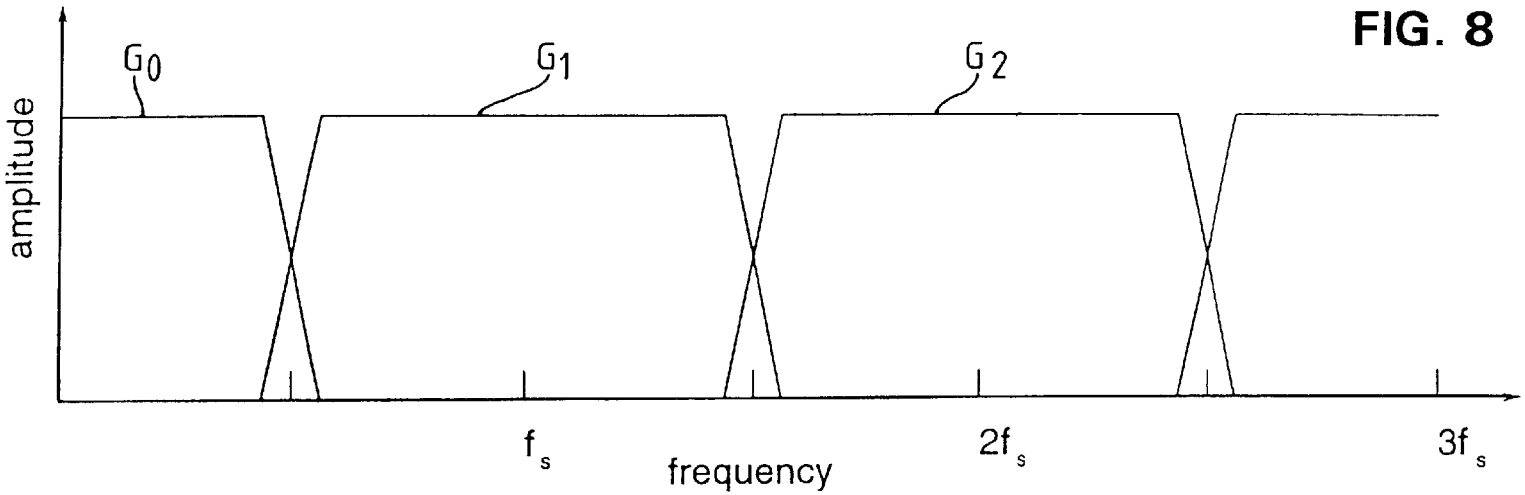
FIG. 8 is a spectrum diagram showing the spectrum of the G (green) samples in an uncorrected arrangement.

If the spatial sampling frequency of the triplets is $f_s$, the G (green) signal, before display, is a series of samples at the same frequency. Thus its spectrum is as shown in FIG. 8 where, without loss of generality, the image spectrum is assumed to be flat up to the Nyquist limit of 0.5 $f_s$, and to be zero beyond it. In practice, if the signal is derived from a higher definition than can be supported by the samples, it may well contain aliasing which may affect the following argument.

The baseband spectrum $G_0(f)$ is simply repeated so that the total spectrum of the samples is:

$$G_0+G_1+G_2+\ldots$$

where:

$G_1(f)=G_0(f-f_s)$ $G_2(f)=G_0(f-2f_s)$

If the image is monochrome, then the R and B signals will be identical.

When displayed, the samples are convolved with the aperture of the display. As shown in FIG. 7, the R, G or B aperture, in the horizontal direction, is approximately a rectangle of width $(1/3)f_s^{-}$. Thus it will have a transform of (sin f)/f form with its first zero at $3f_s$, given by:

$$A(f)=\sin(\pi f/3f_s)/(\pi f/3f_s)$$

Figure 9:
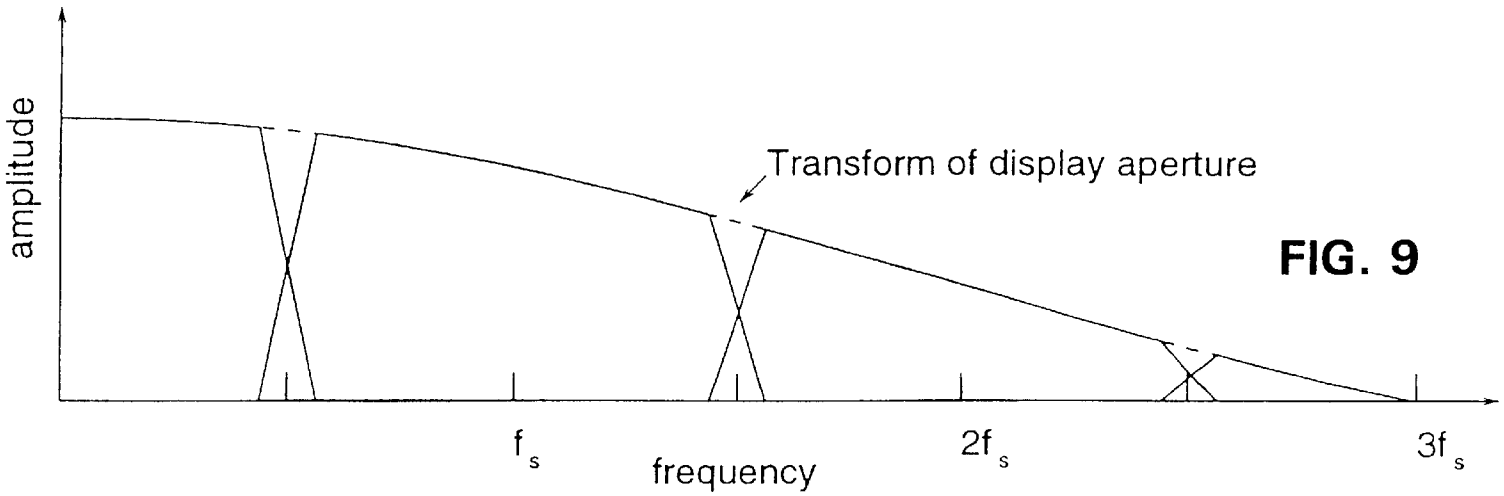
FIG. 9 is a spectrum diagram showing the displayed green component.

If the space origin is chosen to coincide with a G sample, the spectrum of the displayed G is the spectrum of the G samples simply multiplied by the display aperture transform, i.e.:

$$A(f)[G_0+G_1+G_2+\ldots]$$

as shown in FIG. 9. As can be seen, the droop of the Nyquist limit corresponds to a factor of 0.955 or −0.4 dB, whilst the centres of the $G_1$ and $G_2$ spectra are attenuated by factors 0.827 (−1.65 dB) and 0.413 (−7.67 dB) respectively.

Figure 10:
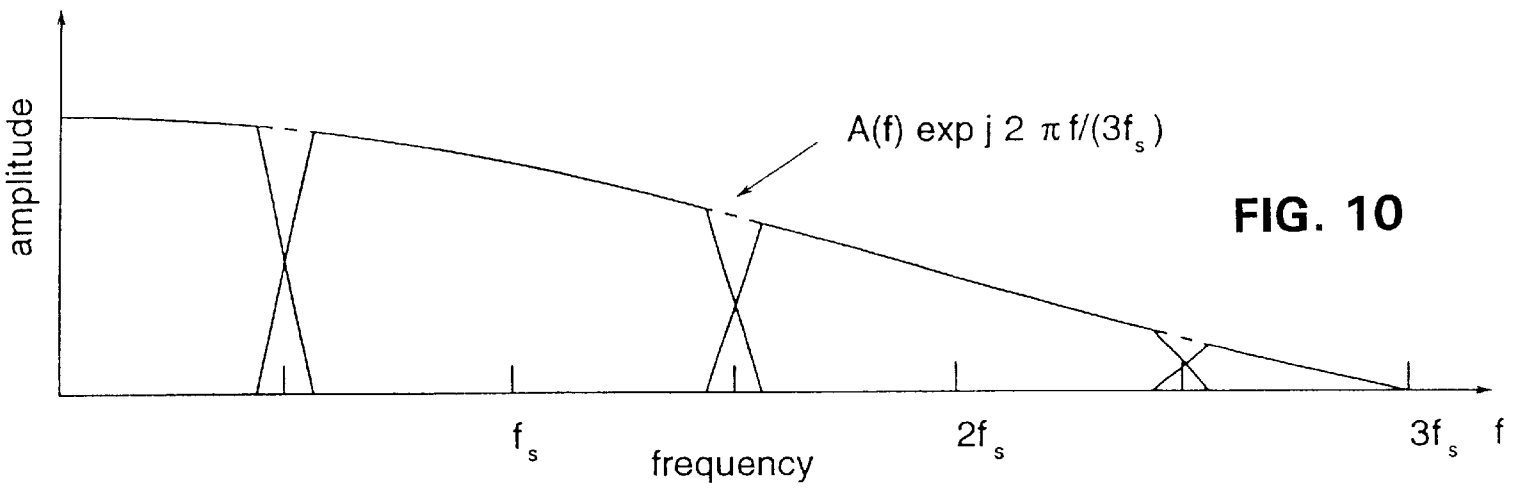
FIG. 10 is a spectrum diagram showing the displayed red component.

However, when the R is displayed, the samples are displaced by $(1/3)f_s^{-1}$ before being convolved. This imposes a factor of:

$$D(f)=\exp j2\pi f(1/3)f_s^{-1}$$

on the spectrum so that the spectrum of the R samples is:

$$D(f)[R_0+R_1+R_2+\ldots]$$

and the spectrum of the displayed R is:

$$A(f)D(f)[R_0+R_1+R_2+\ldots]$$

as shown in FIG. 10. Likewise, when the blue signal B is displayed, the samples are displayed by $-(1/3)f_s^{-1}$ before convolution, so that the spectrum of the displaced B is:

$$A(f)D^*(f)[B_0+B_1+B_2+\ldots]$$

The asterisk indicates the complex conjugate.

The perceived luminance, Y, is composed of the displayed R, G and B and, using the conventional weightings whereby, approximately, $$Y=0.3R+0.6G+0.1B$$

so that, remembering that the R, G and B signals are identical in monochrome areas, the spectrum of the displayed Y is:

$$A(f)[0.3D(f)+0.6+0.1\,D^*(f)][Y_0+Y_1+Y_2+\ldots]$$

The first term in square brackets is complex but, to appreciate the magnitudes involved, the absolute value can be taken. Thus, if:

$$C(f)=\mathrm{Abs}[0.3D(f)+0.6+0.1D^*(f)]$$

then:

$C(f_s/2)=0.8185$ and:

$C(f_s)=C(2f_s)=0.436$ and:

$C(3f_s)=1$

Figure 11:
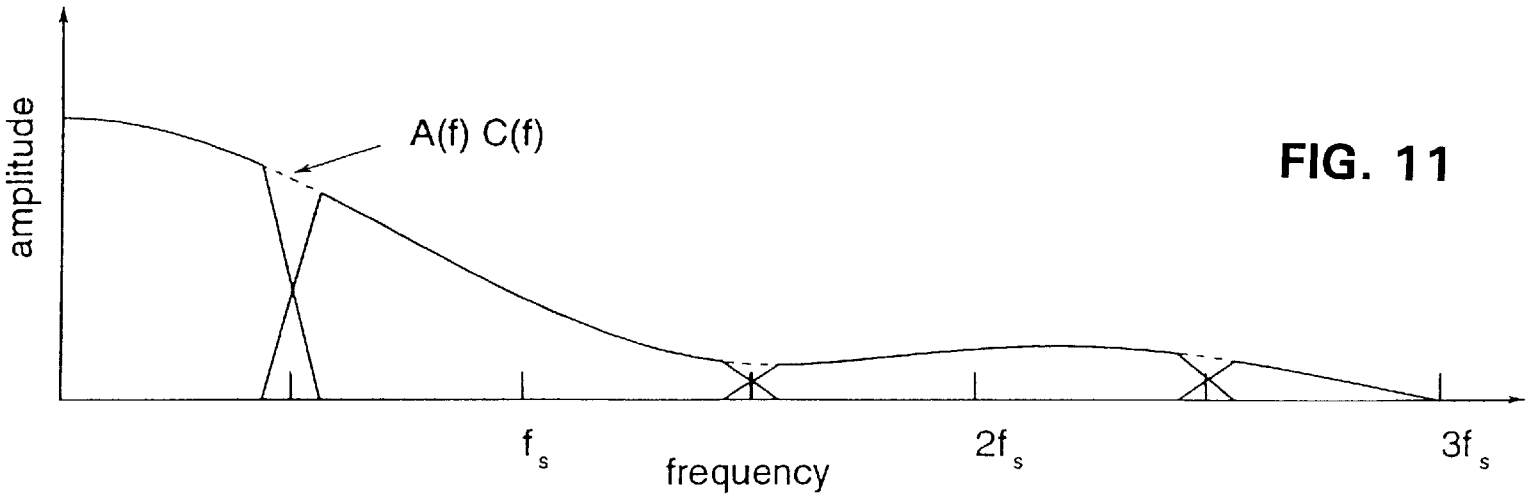
FIG. 11 is a spectrum diagram showing the displayed luminance formed by the red, green and blue components in an uncorrected arrangement.

These are the values at the Nyquist limit and at the centres of the first, second and third order spectra. Including the factor of A(f), the spectrum of the displayed Y therefore appears as in FIG. 11. The droop at the Nyquist limit is now 0.782 (−2.1 dB) whilst the attenuation at $f_s$ and $2f_s$ is 0.361 (−8.9 dB) and 0.180 (−14.9 dB).

The effect of the inclusion of the interpolator circuit 30 will now be considered by reference to the R (red) signal, where the samples are interpolated before display to those that would have been obtained if the samples had been taken at points advanced by $(1/3)f_s^{-1}$. Then the repeated spectra are based on carriers multiplied by exp j2π/3, exp j4π/3, exp j6π/3, . . . so that the spectrum of the R samples is:

$$R_0+R_1\exp j2\pi/3+R_2\exp j4\pi/3+\ldots$$

i.e. the whole of each repeated spectrum has a constant phase shift. Thus, after display, the spectrum of the displayed R is:

$$A(f)[R_0+R_1 \exp j2\pi/3+R_2 \exp j4\pi/3+ \ldots ]$$

Likewise the spectrum of the displayed B is:

$$A(f)[B_0+B_1 \exp -j2\pi/3+B_2 \exp -j4\pi/3+ \ldots ]$$

Then, taking the same expression for Y as before, and assuming R=G=B=Y, the spectrum of the displayed Y is:

$$A(f)[Y_0+Y(0.3 \exp j2\pi/3+0.6+0.1 \exp -j2\pi/3) +Y_2(0.3 \exp j4\pi/3+ 0.6 +0.1 \exp -j4\pi/3+ \ldots ]$$

and the magnitude is:

$$A(f)[Y_0+Y_1C(f_s) +Y_2C(2f_s)+ \ldots ]$$

Figure 12:
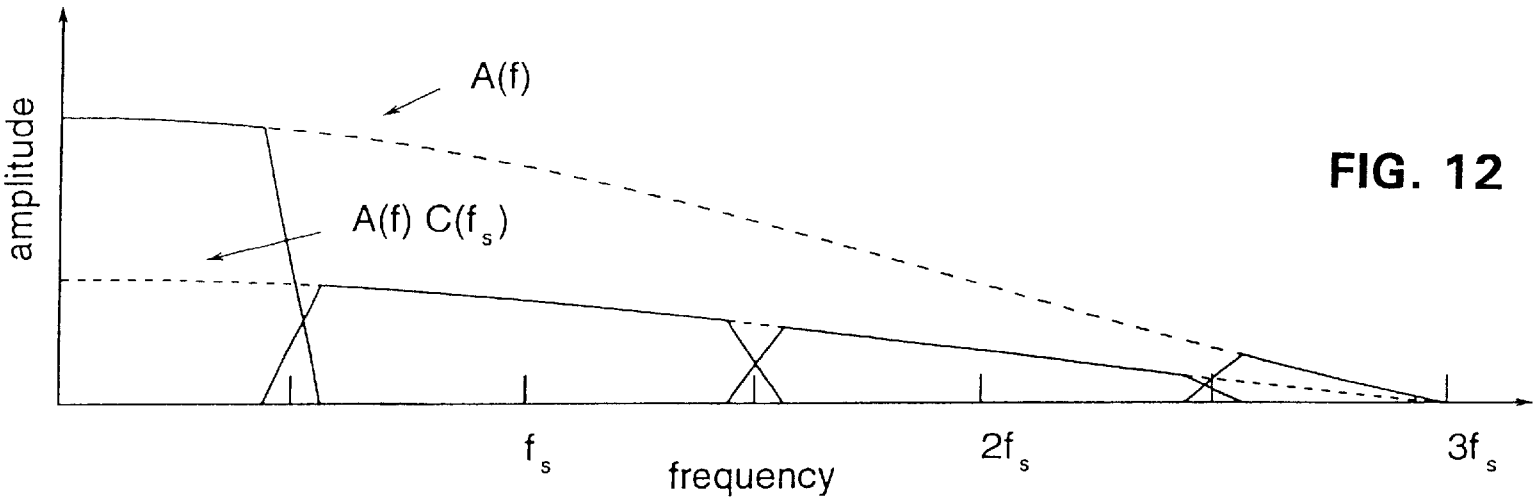
FIG. 12 is a spectrum diagram showing the spectrum of the displayed luminance when the interpolation circuit of FIG. 6 is employed, with offset correction for the red and blue components.

So, aside from the factor A(f) which affects all spectra, the baseband Y spectrum is now unaffected by C whilst the first and second order spectra have relative magnitudes of $C(f_s)$ and $C(2f_s)$, which are equal, as shown in FIG. 12. As can be seen, there is now a distinct difference in amplitude at the Nyquist limit between the wanted spectrum and the alias first order spectrum.

Figure 13:
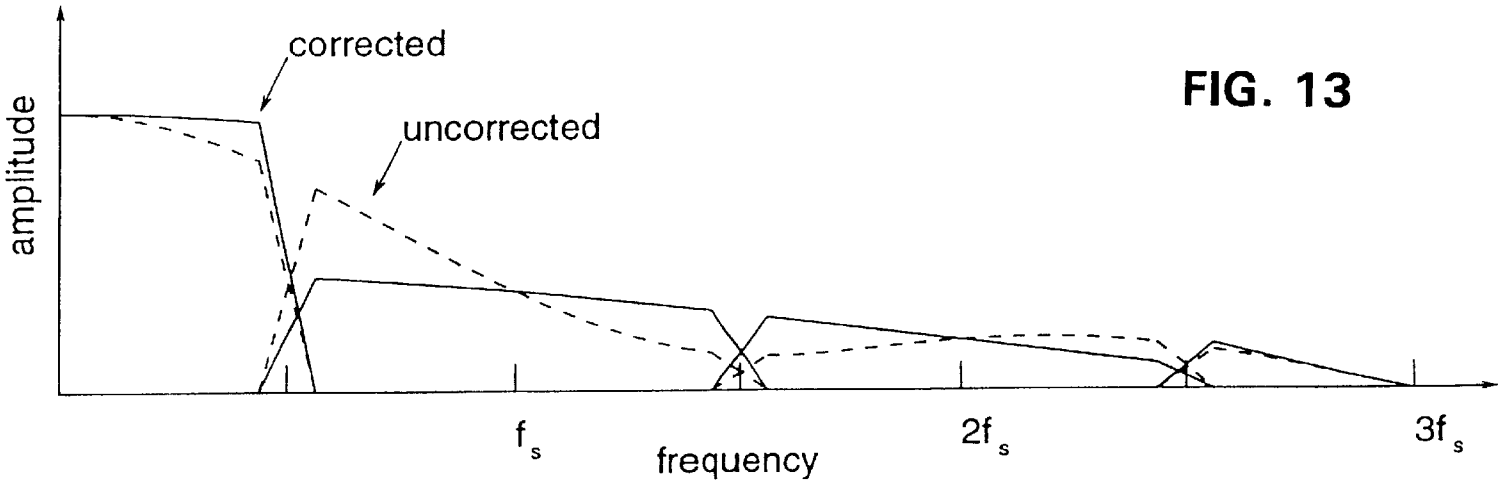
FIG. 13 shows the luminance spectra of FIG. 11 and FIG. 12 together to demonstrate the improvement brought about by the use of the interpolation circuit of FIG. 6.

The comparison with the uncorrected situation is shown in FIG. 13. Whereas in the uncorrected case the wanted and alias components at the Nyquist limit are both at −2.1 dB, in the corrected case the wanted component is at −0.4 dB and the alias component is at −7.6 dB. In comparing the two situations, it must be remembered that the transfer function of the eye is cascaded with the characteristics and it is assumed that the viewing distance is such that spectral components beyond $f_s$ can be disregarded. Thus it is only the Nyquist region which is of interest. Thus, using the conventional matrix relationships between gamma-corrected signals, it is seen that the correction of R and B signals for horizontal offset before application to a plasma display can yield a gain of 1.7 dB for the wanted signal and an attenuation of 5.5 dB for the alias signal, at the band edge, relative to the situation without correction. A direct consequence of the,added discrimination between wanted and alias component's, at the display, is that higher effective resolution can be achieved.

Figure 14:
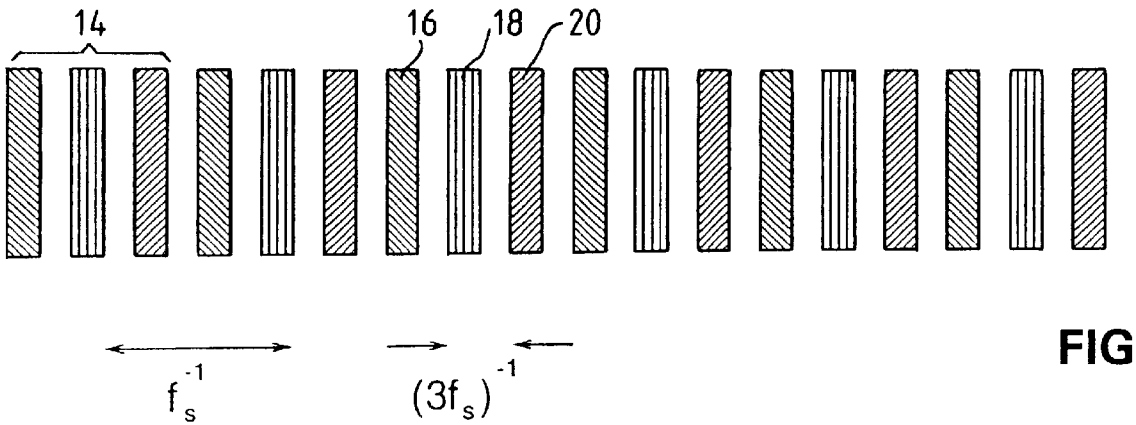
FIG. 14 is a diagram similar to FIG. 7 of a more realistic geometrical arrangement of RGB triplets.
Figure 15:
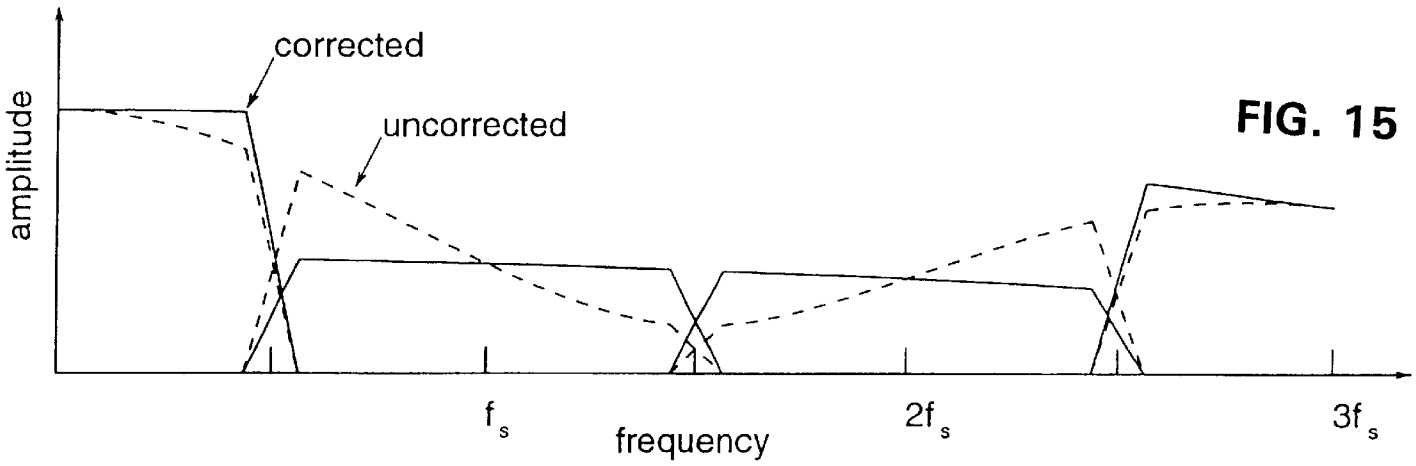
FIG. 15 is a spectrum diagram showing the displayed luminance with and without correction, for the arrangement of FIG. 14.

In practice there will be guard bands between the sub-pixels and also between the triplets, and more typically the sub-pixels will be arranged as shown in FIG. 14. The guard bands between the triplets and between the sub-pixels is such as to create a one-to-one mark-space ratio of: display to non-display areas. If the definitions of frequency remain the same as with FIG. 7 then the only thing that changes is the transform of the aperture, which now has its first zero at $6f_s$ instead of $3f_s$. Thus, all the preceding analysis holds, with C(f) and D(f) unchanged and only A(f) falling away more gently, giving a comparison as in FIG. 15.

Figure 6:
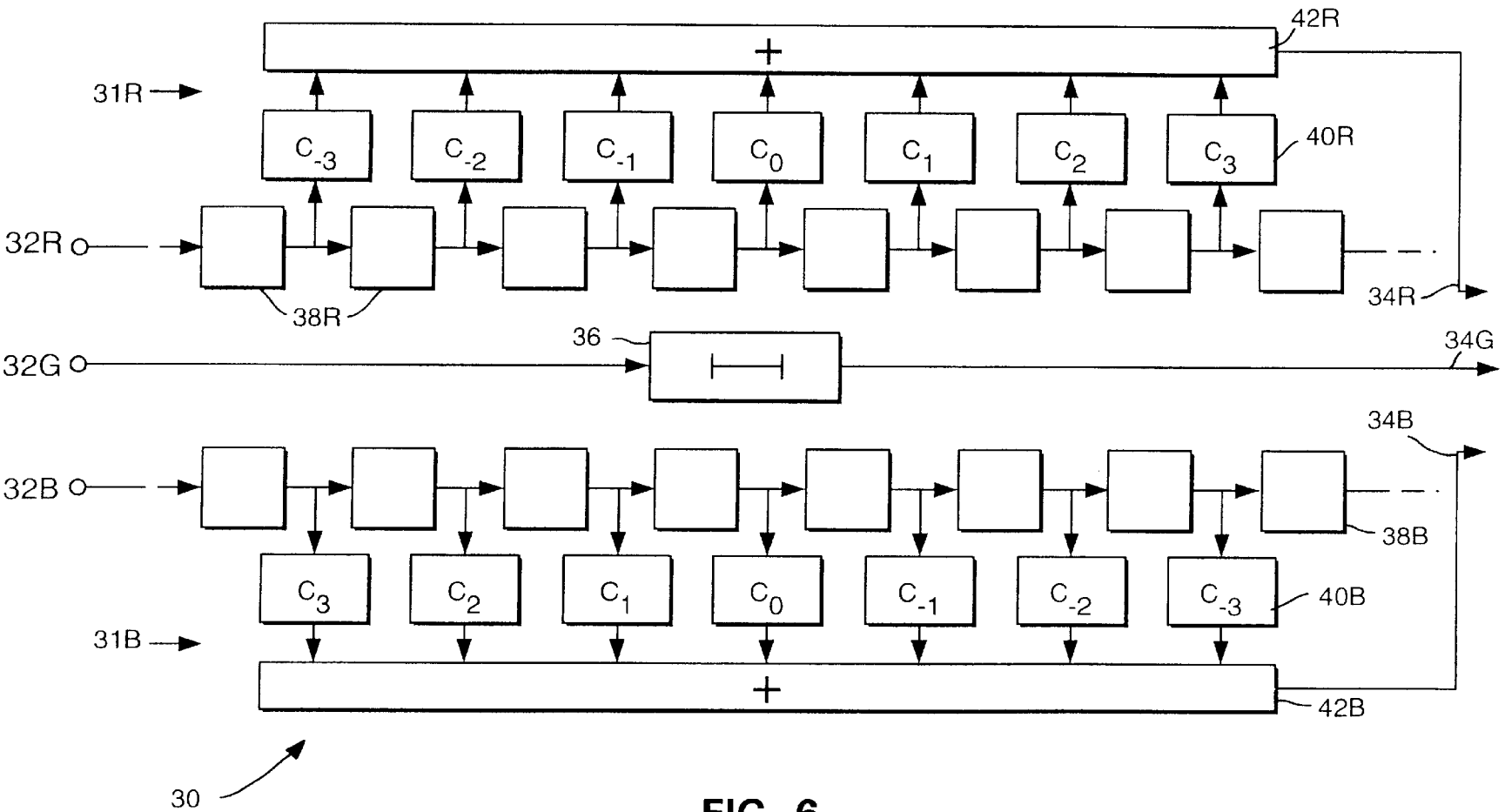
FIG. 6 is a block circuit diagram of an interpolator circuit used in accordance with a first embodiment of the invention.

Comparing With FIG. 13, it might be thought that the effect of adding correction by using the interpolator circuit of FIG. 6 is slightly more marked. Without correction the wanted and alias components at the Nyquist limit are now both 0.809 (−1.8 dB) whereas with correction the wanted component is at 0.988 (−0.1 dB) and the alias component is at 0.431 (−7.3 dB). Thus, although the levels are slightly higher all round, the gain in wanted to alias level separation conferred by offset correction is precisely the same as 7.2 dB.

The net result is to obtain, for the displayed luminance, a significant attenuation of the aliasing and a restoration of the resolution loss up to the Nyquist limit, compared with those associated with the otherwise poor interpolation of a display which does not use compensation for the color component offset in accordance with the invention. The system can accommodate much more aliasing than would be supported by 720 samples per line without the use of compensation for the color component off-set in accordance with the invention.

High Resolution Source Embodiment

If the RGB signals are obtained from a source that has higher resolution than can be supported by the structure of the display, the shape of the band edge is governed by the filter that down-converts from the higher sampling frequency to the display's sampling frequency. It would be wasteful to obtain the phase shift for the R and B signals by operating on them in down-converted form, as this would require two filtering operations and would introduce a further degree of degradation at the band edge. Therefore, the phase-shift is preferably built in to the down-conversion process, as part of the filter design. That is, the interpolator circuit is incorporated in the sample-rate down converter. As noted earlier, "sample-rate" here means samples per picture width.

Figure 16:
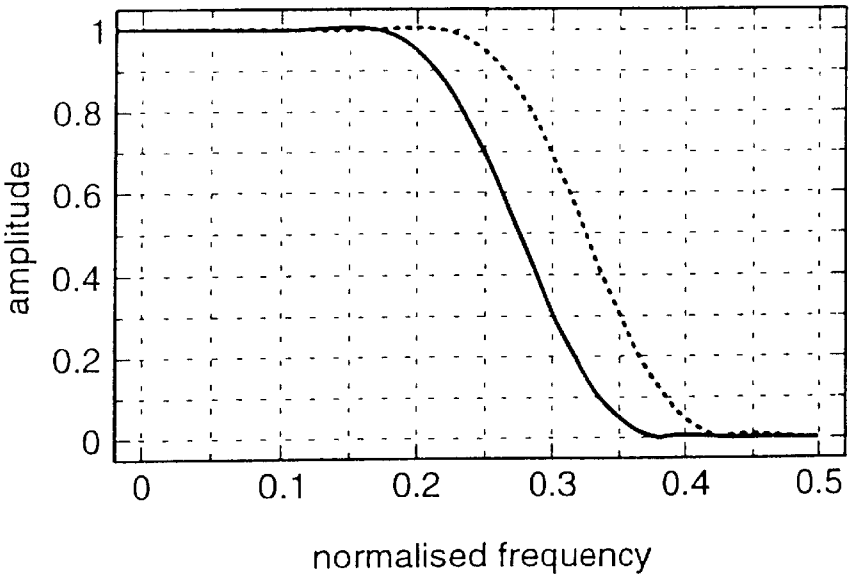
FIG. 16 shows the frequency characteristic of a down-conversion filter that gives an acceptable result, both without and with correction in accordance with this invention.

Without correction, an acceptable result (in terms of the balance between resolution and aliasing) has been demonstrated with a 2:1 down-conversion filter having the frequency characteristic of the solid line in FIG. 16. As can be seen, this is only 0.707 (−3 dB) at the Nyquist limit (0.25 in high-definition frequency) and such a filter necessarily allows a substantial amount of aliasing, which is undesirable.

Figure 17:
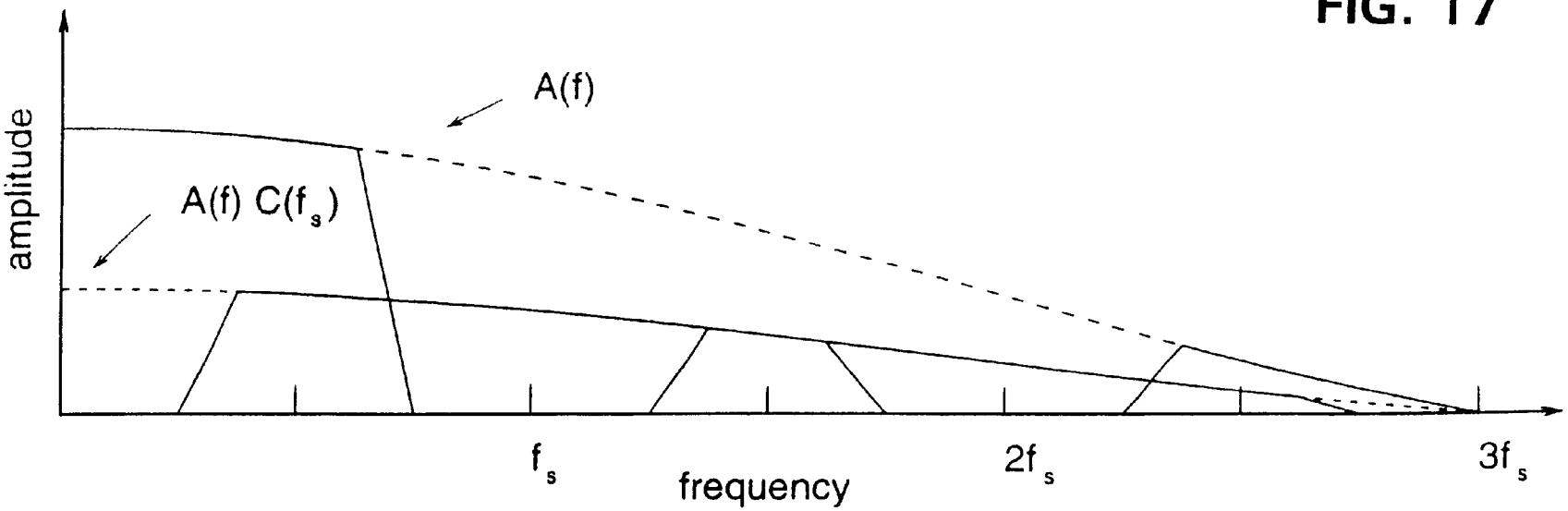
FIG. 17 is a spectrum diagram showing the idealized situation in FIG. 12 with a spectrum that considerably exceeds the Nyquist limit.

FIG. 17 shows the idealized situation of FIG. 12 with a spectrum that exceeds the Nyquist limit by a considerable margin, allowing the aliasing to fold back further into the wanted band. The attenuation of the higher order spectra obtained by using correction for the sub-pixel shift suggests that the frequency characteristic of a practical down-converter could have an even higher gain at the Nyquist limit with a higher cut frequency shown by the dotted line in FIG. 16. The precise shape of the characteristic can be determined by experiment.

Figure 18:
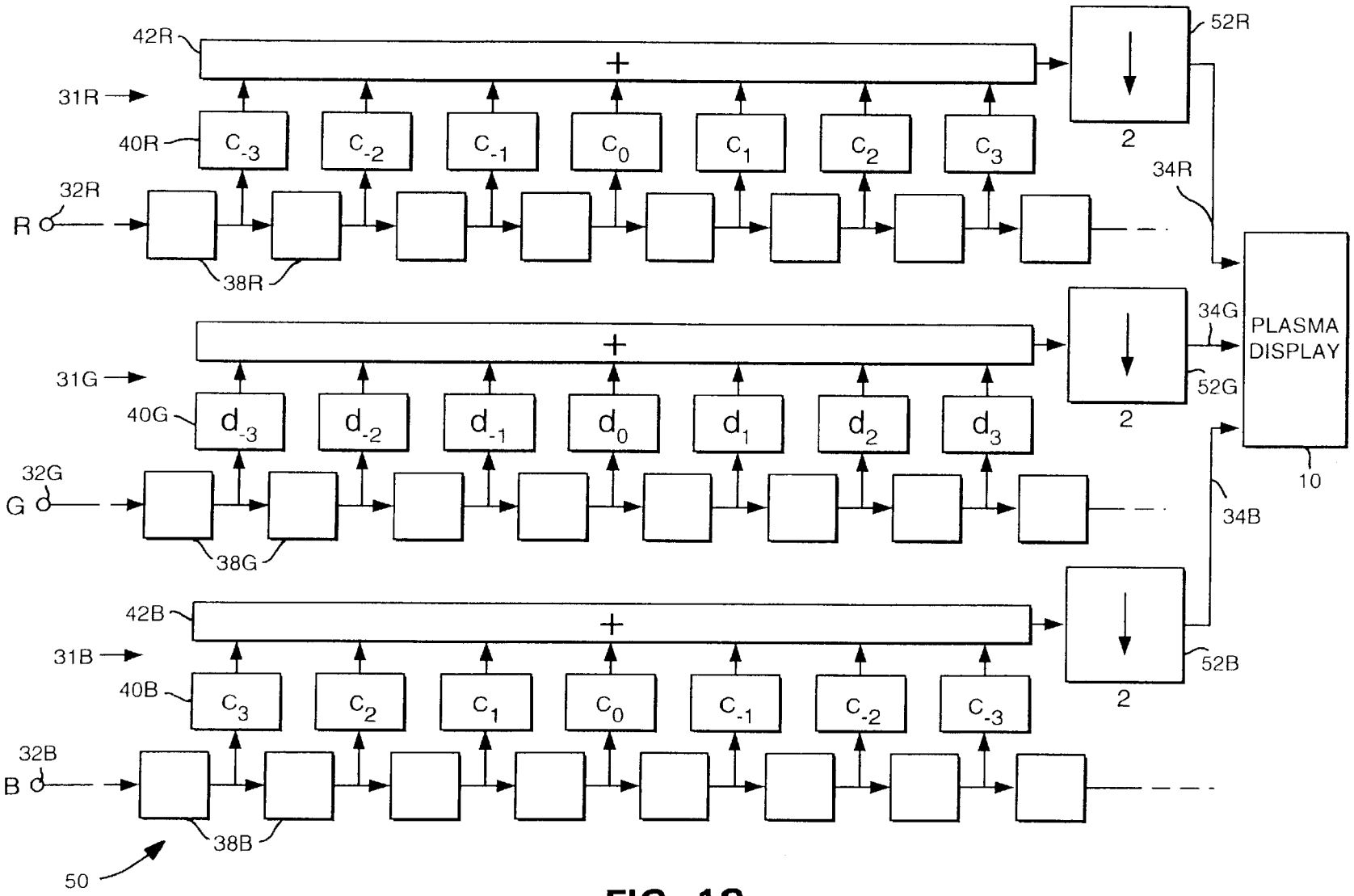
FIG. 18 its a block circuit diagram similar to FIG. 6 of a second embodiment for use with a high resolution source and incorporating down conversion or sub-sampling.

FIG. 18 shows a block diagram similar to FIG. 6 assuming the source sampling frequency is double that of the display. FIG. 18 shows a combined down-converter and interpolator circuit 50, which includes three transversal filters 31R, 31G and 31B. Three inputs 32R, 32G and 32B receive the red, green and blue digital color-component signals respectively. Each input is connected to a respective series of delay elements 38R, 38G and 38B, and the outputs of the delay elements of each series are applied to a series of multipliers 40R, 40G and 40B. In the multipliers the signals are multiplied by fixed coefficients, and the outputs of the multipliers of each series are added in a respective adder 42R, 42G and 42B. The coefficients $c_i$ for the multipliers 38R and 38B are the same but reversed in order, as with FIG. 6, but the coefficients d, for the multipliers 38G are different. The G signal undergoes filtering with coefficients d because of the lowered bandwidth.

In this case the outputs of the adders 42R, 42G and 42B are not applied directly to outputs 34R, 34G and 34B which are connected to the plasma display 10. Down converter circuits or subsamplers 52R, 52G and 52B are included between the adders 42R, 42G and 42B and the outputs 34R, 34G and 34B, respectively, as shown. The sub-samplers, which are of well-known type, serve to reduce the sample rate, in this case by a factor to two.

Table 2 shows the coefficients for all three signals R, G and B corresponding to the dotted characteristic of FIG. 16.

TABLE 2

| | | | |
|---|---|---|---|
| −8 | 0.000496 | 0.000000 | 0.000000 |
| −7 | 0.001860 | 0.001715 | 0.000009 |
| −6 | −0.014869 | −0.002396 | 0.002776 |
| −5 | 0.017381 | −0.013941 | −0.009209 |
| −4 | 0.030114 | 0.037760 | −0.002648 |
| −3 | −0.109508 | −0.011514 | 0.045781 |
| −2 | 0.090782 | −0.109667 | −0.066666 |
| 0 | 0.460016 | 0.648605 | 0.460016 |
| 1 | −0.044293 | 0.273740 | 0.597979 |
| 2 | −0.066666 | −0.109667 | 0.090782 |
| 3 | 0.045781 | −0.011514 | −0.109508 |
| 4 | −0.002648 | 0.037760 | 0.030114 |
| 5 | −0.009209 | −0.013941 | 0.017381 |
| 6 | 0.002776 | −0.002396 | −0.014869 |
| 7 | 0.000009 | 0.001715 | 0.001860 |
| 8 | 0.000000 | 0.000000 | 0.000496 |

The sample rate difference does not have to be an integral multiple. If it is a non-integral multiple, the coefficients used in the transversal filter will not be constant but will vary. Where the ratio is 1.5 for example, two sets of coefficients are required. In more complex arrangements such as with an irrational number ratio the coefficients might need to be adaptively varied.

Thus it has been shown that a plasma display device can be improved by the use of circuitry which modifies at least the R and B color component signals so as to compensate for the displacement of the display elements or sub-pixels for each color component relative to each other in the display array. Surprisingly, this increases the ratio of wanted signal to alias spectrum in the displayed luminance. The luminance quality is thus improved. The modification is effected by transversal filters. The circuitry can be combined with down converters when a high definition source is used. In this case a transversal filter is also included for the G color component signal.

The invention is however not to be limited to the examples described herein which may be subject to many modifications and adaptations, but extends to all structures and methods which fall within the independent claims below.

Thus it is seen that, where the signals are obtained from higher definition sources, the operation of the down-conversion filters in conjunction with the sub-sampling can directly implement the phase offset needed or the R and B signals.

What is claimed is:

1. A color display apparatus, comprising:

a discrete color display device having a two-dimensional array of separate display elements in repeated groups of sub-elements, one sub-element for each color component, the sub-elements in each display element for the different color components being relatively displaced to each other, and supply circuitry for supplying color component signals to the discrete color display device, in which the supply circuitry comprises:

input means for receiving a plurality of input sampled color component signals;

modifying means coupled to the input means and comprising interpolation means for interpolating for each one of at least all but one of the input sampled color component signals to provide a corresponding output color component signal wherein, for each of the input sampled color component signals the interpolation means interpolates, the interpolation means receives a plurality of individual input sampled color component signals for the color component, each input sample color component signal representing the extent to which the color component is to be displayed at a different location on the display, and interpolates the received input sample color; component signals to product an output color component signal that is compensated for the displacement of the sub-elements for each color component relative to each other; and output means for applying the output color component signals produced by said interpolation means and the input sampled color component signals not subject to displacement-compensation interpolation to the discrete color display device.

2. The apparatus according to claim 1, wherein the interpolation means comprises transversal filters.

3. The apparatus according to claim 1, wherein the groups of display elements are arranged in triplets along a line of the display device.

4. The apparatus according to claim 1, wherein the groups of display elements are arranged in two-dimensional triplets.

5. The apparatus according to claim 1, in which the discrete color display device is a plasma display device.

6. The apparatus according to claim 1, in which the interpolation means additionally operates to down-convert each input color component signal to reduce the sample rate of the respective color component signal.

7. The apparatus of claim 1, wherein said interpolation means, for each of the input color component signals, interpolates a plurality of successively time displaced samples of the color component, each said sample representing the extent to which the color component is to be displayed at a different location on the display.

8. The apparatus of claim 1, further including a filter for filtering the one input sampled color component signal not subject to displacement-compensation interpolation prior to applying the input sampled color component signal to the display device.

9. A method of displaying a color image on a discrete color display device comprising the steps of:

providing al discrete display device, said display device having a Plurality of separate display elements, each said display element having three sub-elements, each sub-element for a separate color component, the sub-elements for each display element being relatively displaced to each other;

receiving three input sampled color component signals;

modifying at least two of the input color component by signals by interpolation wherein, the interpolation step is performed by interpolating a plurality of individual samples of the color component signal for the color component, each sample representing the extent to which the color component is displayed at a different location on the display so as to produce an output color component that is compensated for the displacement of the sub-elements for each color component relative to each other on the discrete display device; and applying the output color component signals produced as result of the displacement-compensating interpolation step to the display device and applying any received input sampled color component signals not subjected to the displacement-compensating interpolation step to the display device.

10. The method according to claim 9, in which the input color component signals are digital signals.

11. The method according to claim 9, wherein, in said modifying step a plurality of time displaced samples of the color component signal are received, each sample representing the extent to which the color component is displayed at a specific location on the display.

12. The method according to claim 9, further including the step of filtering the received input sampled color component signal not subject to the display-compensating interpolation step prior to applying the input sampled color component signal to the display device.

13. The method of claim 9, wherein the interpolation of the input sampled color components signals subjected to display-compensation interpolation is performed by a transversal filter.

14. A display apparatus, said display apparatus including:

a color display having a plurality of display elements, each said display element comprising a plurality of sub-elements, each sub-element displaying a different color component, said sub-elements within each said display element being displaced from each other;

an input port for receiving a plurality of sampled color component signals, each color component signal corresponding to a control signal for said display sub-elements for one of the color components;

an interpolator for receiving the sampled color components signals, said interpolation circuit comprising:

at least one interpolation circuit for receiving a plurality of samples of the color component signals for a specific one of said color components; said interpolation circuit having a plurality of multipliers and an adder that are configured to interpolate the received sample color component signals to produce an output color component signal for application to said display wherein, said interpolator has a sufficient number of said interpolation circuits so that all but one of ;said color component signals are subjected to interpolation; and said multipliers and said adder forming each said interpolation circuit are configured to produce an output color component signal that is compensated for the displacement of said display sub-elements associated with the color component to which the output color component signal is applied; and a pass through circuit for receiving samples of the one color component signal not applied to said interpolation circuits and applying the received samples of the one color component as an output color component signal to said display.

15. The display apparatus of claim 14, wherein each said interpolation circuit includes a delay circuit between adjacent said multipliers, said delay circuit being configured to receive the sampled color component signal applied to one said multiplier and, on a subsequent interpolation, to apply the sampled color component signal to a second said multiplier so that the interpolation performed by said interpolation circuit is performed on a plurality of successively time displaced samples of the color component signal.

16. The display apparatus of claim 14, wherein said display elements are arranged in a plurality of lines and each said display element has three separate sub-elements.

17. The display apparatus of claim 14, wherein said display device is a plasma display device.

18. The display apparatus of claim 14, wherein:

said interpolation circuits take a selected period of time to produce the output color component signals; and said pass through circuit includes a delay element that delays the outputting of the received samples of the one color component signal for a time period equal to the time which said interpolation circuits take to produce forwarding of the output color component signals.

19. The display apparatus of claim 14, wherein:

each said interpolation circuit further includes a sub-sampler to which the output from said interpolation circuit adder is applied and said sub-sampler down converts the samples of the color component signal so that said interpolation circuit produces output color component signals at a rate less than the rate at which the samples of the color component signal are received; and said pass through circuit includes a sub-sampler to which the samples of the color component signal received by said pass through circuit are applied and said sub-sampler is configured to output the color component signals produced by said pass through circuit at a rate less than the rate at which the samples of the color component signal are received.

20. The display apparatus of claim 19, wherein said pass through circuit further includes a transverse filter for filtering the samples of the color component signal received by said pass through circuit and the output of,said transverse filter is applied to said sub-sampler.

21. The display apparatus of claim 14, wherein said multipliers and adder that forms each said interpolation assembly comprise a plurality of discrete components.

* * * * *